United States Patent [19]

Geiszler et al.

[11] 3,956,743

[45] May 11, 1976

[54] MOTION DETECTION SYSTEM

[75] Inventors: Theodore D. Geiszler, Los Gatos; Richard Wilenken, San Jose, both of Calif.

[73] Assignee: Theodore D. Geiszler, Los Gatos, Calif.

[22] Filed: Mar. 14, 1973

[21] Appl. No.: 341,171

[52] U.S. Cl. ..... 340/258 C; 307/251; 340/216

[51] Int. Cl.[2] ..... G08B 13/24

[58] Field of Search ..... 340/258 C, 216, 261; 317/148.5 R; 307/131, 251

[56] References Cited

UNITED STATES PATENTS

| | | | |
|---|---|---|---|
| 3,484,775 | 12/1969 | Cline | 340/216 |
| 3,541,398 | 11/1970 | Simister | 340/258 C |
| 3,558,921 | 1/1971 | Yokozawa et al. | 307/251 |
| 3,569,923 | 3/1971 | Naubereit et al. | 340/261 |
| 3,673,589 | 6/1972 | Barrett et al. | 340/258 D |
| 3,733,597 | 5/1973 | Healey et al. | 307/251 |
| 3,747,703 | 7/1973 | Knowd et al. | 340/261 |
| 3,753,132 | 8/1973 | Hill | 307/251 |
| 3,771,152 | 11/1973 | Dettling et al. | 340/258 C |

*Primary Examiner*—Glen R. Swann, III

*Attorney, Agent, or Firm*—Spencer & Kaye

[57] ABSTRACT

A motion detection apparatus indicates the presence of an object in a given area by sensing the change in electrostatic charge in the area caused by the disturbance of the electric field within the range of the apparatus. An antenna, which may take a number of different forms, is placed at a convenient location within the area to be monitored, and the output of the antenna is connected in a shielded manner to the input of a shielded high gain amplifier with a very high impedance-low leakage current input stage and which has a filter connected thereto having a cut off frequency of up to approximately 20Hz. Connected to the output of the amplifier is a circuit, which may include a power line frequency filter, which produces an output signal, for example, an alarm, whenever the amplitude of the output signal from the amplifier exceeds a predetermined value.

21 Claims, 6 Drawing Figures

MOTION DETECTION SYSTEM

BACKGROUND OF THE INVENTION

The present invention relates to an improved apparatus for detecting the presence of an object, e.g. an intruder, within a given area. More particularly, the present invention relates to an improved apparatus for detecting the presence of an intruder within a given area by detecting the change in electrostatic charge caused by the disturbance by the intruder of the electric field within the given area.

Various types of intrusion detection systems are known in the art. One type of intrusion detection system which has been proposed is to utilize a high impedance sensing device, for example, an antenna, which is placed within the area to be monitored and produces an electric field therein, and then to detect any change in the charge on the antenna due to the electric field being disturbed by the intruder. The change in charge is then converted to an electrical signal which is used to provide an indication.

Although the prior proposed systems operate in theory, a number of difficulties arise when it is attempted to use these systems in practical applications. These difficulties arise as a result of the particular type of signal which is being detected, which is very small. Consequently, the charge detecting circuitry must be very sensitive so that it can respond to the very small signals produced by the induced charges or a very large antenna must be used. Additionally, when using such circuits in a convential environment, for example, either in or in the vicinity of a home or building, for the detection of an intruder, a problem arises as a result of random electric fields in the surrounding area which can likewise induce charges in the antenna. For example, one type of changing electric field which is commonly present in buildings is that resulting from the 60 Hz electrical power in the building. The fields from the power lines and other electrical apparatus connected thereto tend to saturate the detecting circuitry, thus preventing any effective detection of the relatively small charges induced by intruders, or at least tend to produce erroneous indications. As a result of these limitations, the intrusion detection systems previously proposed are severely limited in their use.

SUMMARY OF THE INVENTION

It is therefore an object of the present invention to provide an improved passive intrusion detection system which functions by detecting the change in electrostatic charge caused by the disturbance of the electric field about an antenna, but which overcomes the problems of the prior art.

More particularly, it is an object of the present invention to provide an intrusion detection system of the above mentioned type which does not require the generation of an electric field by the antenna, which is not sensitive to the random fields which may be present in the environment in which the system is used and which may be constructed in a very simple and relatively inexpensive manner.

The above objects are achieved according to the present invention in that the output of the antenna utilized to detect the charge is connected in a shielded manner to the input of a high gain amplifier having a high impedance-low leakage current input stage which forms a portion of a shielded charge detection circuit, which further includes a filter for filtering out signals above approximately 20 Hz which is connected to the high gain amplifier. Circuit means are connected to the output of the amplifier for producing an output signal whenever the amplitude of the output signal from the amplifier exceeds a predetermined value. Preferably, an additional filter for filtering out power line frequency signals is connected between the output of the amplifier and the input of the circuit means.

As a result of this filtering arrangement, the circuit is not responsive to any field of the power line frequency but rather responds only to signals below approximately 20Hz which would include any signals resulting from electrostatic charge changes induced by an intruder. The first mentioned filter, which is preferably connected to the input of the amplifier, provides the further advantage that the system will not respond to very fast moving objects, i.e. objects moving at a rate which is faster than a rate of movement possible for any intruder of the type which is of interest. Additionally, as a result of the high gain of the amplifier, it is possible to cover a relatively large area with a very small antenna.

According to a preferred embodiment of the invention, the high gain amplifier is a differential amplifier formed by an operational amplifier with a feedback resistance and the high impedance-low leakage current input stage of the amplifier is formed by a field effect transistor. Preferably, according to a further feature of the invention, the gain of the operational amplifier is shaped so that it has very low gain for d.c. signals and for signals above approximately 1Hz. This shaping of the gain of the amplifier is preferably provided by means of a bandpass filter connected in the feedback path of the operational amplifier which provides for roll-off of the gain of the amplifier for frequencies above approximately 1.0 Hz and below approximately 0.01Hz. According to a further feature of the invention, when the input stage of the high gain amplifier is formed by an insulated gate field effect transistor, a pair of back to back diodes are connected between the gate electrode or input of the field effect transistor and ground, which diodes have a lower leakage current than the leakage current of the insulated gate field effect transistor, in order to prevent any charge from being induced at the gate electrode of the field effect transistor which would tend to instantly burn it out.

According to still a further feature of the invention, the antenna may be simply a wire or a small conductive plate, for example a one inch by one inch square plate, or if desired, a ground plane may be provided for the plate. Additionally, the antenna may be connected via a piece of coaxial cable whose center conductor is connected to the input terminal of the amplifier and whose shield is connected to ground, and more than one antenna may be so connected to a single amplifier.

DETAILED DESCRIPTION OF THE PREFERRED EMBODIMENTS

Figure 1:
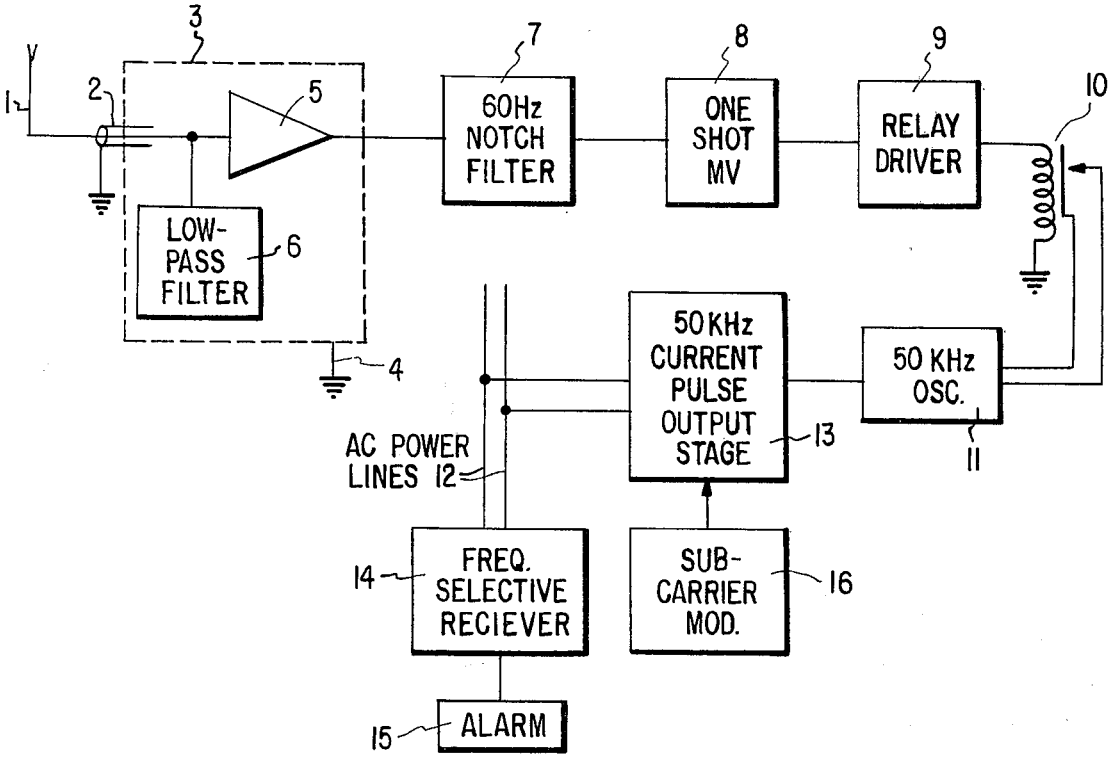
FIG. 1 is a block circuit diagram of the intrusion system according to the invention.

Referring now to FIG. 1, there is shown an antenna 1 which is suitably located in the area to be monitored for the presence of the intruders. The antenna is connected in a shielded manner, e.g. by means of a piece of shielded cable 2 whose shield is grounded, to the signal input of a charge detection circuit 3 which is also shielded against stray signals, for example by placing same in a grounded enclosure as schematically indicated by the ground connection 4. The charge detection circuit 3 basically includes a high gain amplifier 5 which, in view of the high impedance of the antenna and the low currents to be detected, has a high impedance-low leakage current input stage, and a low pass filter 6 for the purpose of filtering out signals above approximately 20 Hz which is connected to the signal input of the amplifier 5. The output of the high gain amplifier 5 is connected to a filter 7 for filtering out power line frequency signals, e.g. 60 Hz. Preferably the filter 7 is a power line frequency notch filter, i.e. a filter which essentially passes all frequencies other than the power line frequency. The output of the filter 7 is in turn detected and utilized in any conventional manner to provide an indication which may for example be an alarm.

According to the illustrated embodiment, the output of the filter 7 is fed to a one shot multivibrator 8, which will be switched to its on state whenever the input signal thereto exceeds a predetermined value and provides an output pulse for a predetermined period of time, for example, 3 seconds, and then return to its off state. The output pulse from the one shot multivibrator is fed to a relay driver stage 9 of the conventional design which will then energize a relay 10 for the period of time that the one shot multivibrator 8 is in its on state. Closure of the relay contacts of the relay 10 causes the energization of an oscillator 11 which oscillates at a predetermined constant frequency. The output signal from the oscillator 11, which may for example be a multivibrator, may then be transmitted to a remote location for detection and indication.

Preferably, as illustrated in FIG. 1, the output signal from the oscillator or multivibrator 11 indicating that an intruder has been detected, is transmitted to a remote location for example, another room in the building, via the conventional 110 volt a.c. power lines 12 for the building. Accordingly, in order that the output signal from the oscillator or multivibrator 11 be able to be superimposed on the power lines 12, the frequency of the oscillator 11 is selected to be substantially higher than that of the power line frequency; for example, a frequency of 50KHz is selected for the frequency of the oscillator 11. The output of oscillator 11 is then fed to a power stage 13 which produces current pulses on the power line at the frequency of the input signal thereto. For example, with a 50KHz signal, the output stage 13 could impress 100 ma current pulses at the 50KHz repetition rate on the power lines. At the remote location, a frequency selective receiver 14 is provided whose signal input is connected to the power lines 12 and which is responsive to the frequency of the oscillator 11. The output of the receiver 14 is connected to an indicator or alarm 15 to provide an indication of the presence of an intruder in the area being monitored by the antenna 1. Since more than one output stage 13 may be feeding signals to a common receiver 14, in order to be able to identify the particular location from which the signals originate, preferably a subcarrier frequency modulator 16 is connected to the output stage 13 to modulate the output signal thereof with a signal which indentifies the particular output stage 13.

Figure 2:
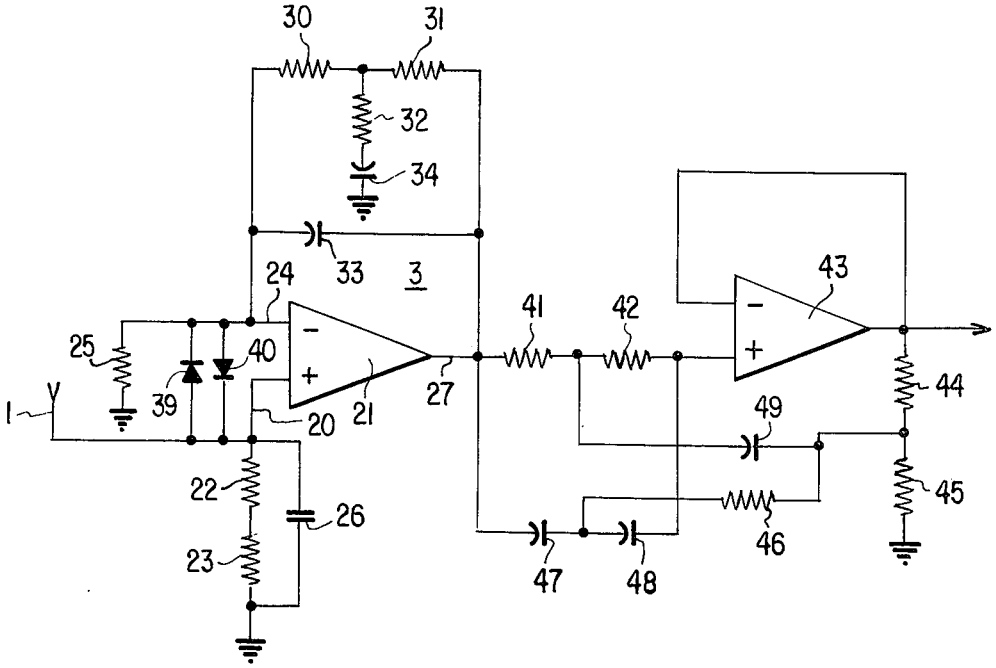
FIG. 2 is a schematic circuit diagram of a preferred embodiment of the charge detection circuit and notch filter of FIG. 1.
Figure 4:
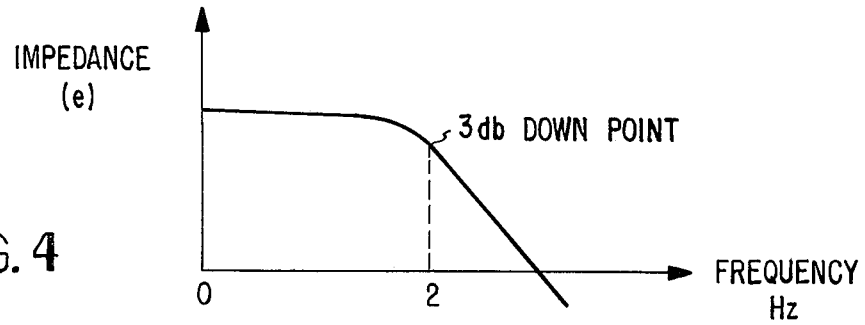
FIG. 4 is a curve illustrating the frequency response of the low-pass filter of FIG. 2.

Referring now to FIG. 2, there is shown a preferred embodiment of the charge detection circuit 3 and the notch filter 7 of FIG. 1. The high impedance antenna 1 is connected to the non-inverting, i.e, positive, signal input 20 of an operational amplifier 21 which has a high impedance-low leakage current input stage as will be more fully discussed below. In any case, the leakage current of the input of the operational amplifier should be less than 5 picoamperes, and preferably less than 1–2 picoamperes. Connected between the input 20 and ground are two series connected resistors 22 and 23 having a relatively high value. The voltage drop across these resistors 22 and 23 resulting from the current caused by the charges induced in the antenna 1 determines the input signal to the amplifier 21. The second signal input 24 of the operational amplifier 21 is connected to ground via a high ohmic resistor 25. Connected in parallel with the resistors 22 and 23 is a capacitor 26 which is dimensioned such that the circuit 22, 23, 26 forms a low pass filter having a cut off frequency, i.e. the point at which the response curve is 3 db down, of approximately 2Hz. The response curve for the low pass filter is illustrated in FIG. 4. Typical values for the elements used to provide the desired low pass filter would be to have the resistors 22 and 23 each equal to 22 megohms and to use a capacitor equal to 1000pf.

In order that the operational amplifier 21 be provided with the desired amount of gain, a feedback resistance having a very high ohmic value is connected between the output 27 and the input 24 of the operational amplifier 21. Typically, the feedback resistance should have a value of approximately $10^{12}$ ohms so that with a resistance 25 of approximately 22 megohms, the gain of the operational amplifier will be approximately 40,000. It should be noted however that gains of this magnitude are not entirely necessary, but the gain of the amplifier should be at least in the order of 2,000 or more. Since it is very difficult to provide simple resistances of the magnitude necessary for the feedback resistance of the amplifier 21, and for a further reason to be explained below, as shown in the figure, the high value feedback resistance is realized by a T-network including two resistors 30 and 31 connected in series between the input 24 and the output 27 of the operational amplifier 21, and a further resistor 32 connected between the junction of the resistors 30 and 31 and a.c. ground. Typical values for the resistors of this T-network in order to provide the above mentioned high resistance would be 22 megohms for each of the resistors 30 and 31 and 1000 ohms for the resistor 32.

Figure 5:
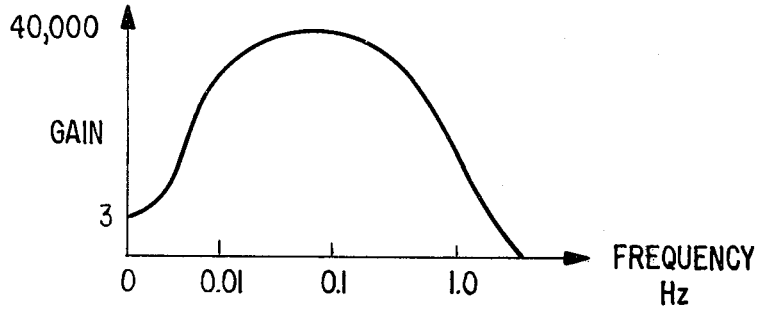
FIG. 5 is a curve illustrating the shaped gain of the high gain amplifier of FIG. 2.

In order to further reduce the sensitivity of the amplifier to stray signals, and in particular signals resulting from the 60Hz power lines, a capacitor 33 having a value for example, of 1pf, is also connected between the output 27 and the input 24 of the operational amplifier 21. The capacitor 33 together with the feedback resistance formed by the T-network 30–32 forms in effect a low pass filter for the feedback signal and effectively shapes the upper end of the gain characteristic of the amplifier. The low pass filter formed by the feedback network for the amplifier 21, with the typical parameters mentioned above, will cause a roll-off of the gain for frequencies above approximately 0.2Hz. Additionally, since operational amplifiers, and in particular operational amplifiers which are used as differential amplifiers as in the present case, have an off-set voltage, i.e. a d.c. level which is inherently present on the input terminal thereof, and which is undesirable, particularly in the present situation wherein signals of a very low frequency are being detected, the gain characteristic of the amplifier also is shaped to provide roll-off below approximately 0.01Hz so that the amplifier will have very low gain for d.c. signals. This shaping of the gain characteristic at the low end is provided by connecting a capacitor 34 between the resistor 32 and ground with the capacitor 34 typically having a value of 63$\mu$f. The capacitor 34 together with the resistors 30 to 32 thus form a filter for the feedback signal, so that the net effect of the elements 30 to 34 is to provide a bandpass filter characteristic for the amplifier. The shaping of the gain characteristic of the amplifier 21 as a result of the filtering in the feedback path is shown in FIG. 5.

Figure 3:
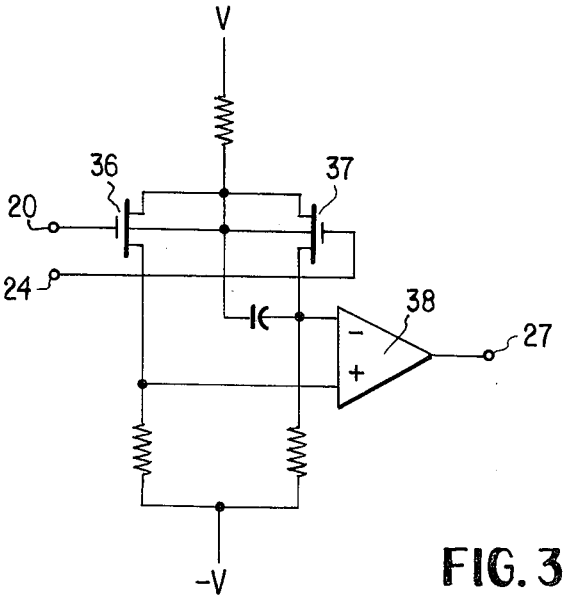
FIG. 3 is a more detailed schematic circuit diagram of the operational amplifier of FIG. 2 showing the high impedance-low leakage current input stage.

As mentioned above, in view of the high impedance of the antenna and the very small signals applied to the input of the operational amplifier 21, the operational amplifier 21 must be provided with a high input impedance-low leakage current input stage. As shown in FIG. 3, the desired high impedance-low leakage current input stage is realized by using field effect transistors as the active element of the input stage. As shown in FIG. 3, each of the signal input terminals 20 and 24 of the operational amplifier 21 is connected to the gate electrode of a respective insulated gate field effect transistor 36 and 37. The source-to-drain-current-paths of both field effect transistors 36 and 37 are connected in parallel across a source of operating potential V. The outputs of the field effect transistors 36 and 37 are then fed to the remaining stages of the operational amplifier which are indicated schematically in this figure by the amplifier 38. The operational amplifier shown in FIG. 3 may be constructed of conventional components. Alternatively, integrated circuits may be utilized. For example, the amplifier 38 may be a conventional integrated circuit operational amplifier such as the $\mu$A741 which is manufactured for example by Texas Instruments Corp., or the integrated circuit operational amplifier 8741C manufactured by Intersil Inc. Alternatively, the entire structure shown in FIG. 3 may be the integrated circuit operational amplifier ICH 8500 manufactured by Intersil Inc. It should further be noted, that although insulated gate field effect transistors are preferable as the input stage for the operational amplifier 21, junction field effect transistors may be utilized if desired.

As pointed out above, insulated field effect transistors have a major problem when used in a practical circuit. That is, since they are characterized by extremely high input impedance, and consequently have very little input current flow, any charge induced at the input of the amplifier 21, and hence the gate electrodes of the field effect transistors 36 and 37, will instantly burn out the field effect transistors of the input stage. Consequently, some form of protection is necessary for the input of the amplifier since the antenna or the input terminals themselves will normally be handled or touched during use thereof or the system may be located in areas of significant static discharge, all of which would cause the undesirable effect of inducing a charge at the input of the amplifier to burn out the field effect transistor input stage. In order to prevent such an occurrence, as shown in FIG. 2, a pair of back to back diodes 39,40, are connected in parallel between the input terminals 20 and 24 of the operational amplifier 21. It should be noted, however, that in order for the circuit to operate properly, it is necessary that these diodes have a current leakage characteristic which is less than that of the input stage of the amplifier 21. This is necessary since if the diodes have a greater current leakage characteristic than that of the input stage of the amplifier, this would result in the input impedance of the amplifier being lowered and consequently a reduction, and possibly the absence of any sensitivity or gain. It has been found that a diode network suitable for use as the diodes 39,40 may be the DX–100 network of Intersil, Inc.

It should be noted that protection of the intput stage of amplifier 21 against burnout is also provided by the capacitor 26. Since the capacitor 26 in combination with the input resistors 22 and 23 acts as a low pass filter, a low impedance path to ground will be provided for spikes resulting, for example, from a direct touching of the antenna 1. This low impedance path will enable the diodes 39,40 to have sufficient time to react.

Figure 6:
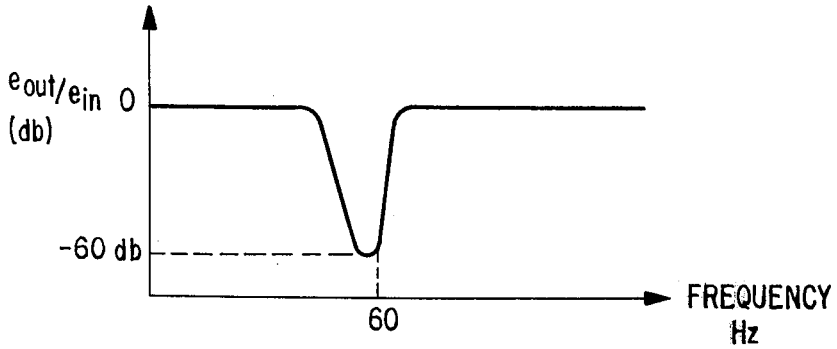
FIG. 6 is a curve illustrating the frequency response of the notch filter of FIG. 2.

As shown in FIG. 2, the output 27 of the operational amplifier 21 is connected via two series connected resistors 41 and 42 to one input of a further operational amplifier 43, for example the above mentioned $\mu$A741, whose output is directly connected to its other signal input terminal. The amplifier 43 together with the interconnected resistors and capacitors 41, 42, and 44 to 49 form the desired 60Hz notch filter for providing additional suppression of any 60Hz pickup. Preferably, as shown in FIG. 6, the 60Hz notch filter has a characteristic such that it will pass signals other than 60Hz with no gain and will suppress 60Hz signals by approximately 60 db. Typical values for the notch filter illustrated in FIG. 2 are as follows:

| | | |
|---|---|---|
| Resistors 41 and 42 | 2.7 | megohms |
| Resistor 44 | 10 | kilo ohms |
| Resistor 45 | 1 | kilo ohm |
| Resistor 46 | 1.3 | megohms |
| Capacitors 47 and 48 | 1000 | pf |
| Capacitor 49 | 2000 | pf |

Although the notch filter illustrated is preferred, it is to be understood that any filter which will provide the desired suppression of the power line frequency signals may be utilized.

In the operation of the circuit shown in FIGS. 2 and 3, any charge detected by the antenna 1 will produce a voltage drop across resistors 22 and 23 which will produce an input signal between the input terminals 20 and 24 of the operational amplifier 21. Signals above approximately 2Hz are filtered out by the low pass filter formed by the network 22,23,26. As a result of the shaped gain of the amplifier 21 caused by the filter formed by elements 30 to 34, substantially only signals between 0.01Hz and 0.2Hz will be amplified by the total gain of the amplifier, for example, 40,000. Additionally, since as a result of the shaping of the gain of the amplifier so that it has low gain at d.c., the d.c. off-set voltage, i.e. the self generated voltage which occurs at the input of such operational amplifiers and which would tend to saturate the amplifier if it were multiplied by the very high gain utilized in the present circuit, is as shown in FIG. 5 only multiplied by a gain of approximately 3 so that it has very little effect on the operation. The output signal from the amplifier 21, which in spite of the previous filtering thereof still may contain a substantial amount of 60 Hz pick-up is then fed to the notch filter which suppresses any 60Hz signal to a value which will not cause energization of the subsequent indicating circuitry.

The present invention has the advantage that as a result of the high selectivity and gain of the detecting circuitry, it is possible to utilize very small antennas and still be able to cover a substantially large area. Depending on the particular application for the system, this antenna may take a number of different forms. For example, the antenna may be simply a piece of wire or a rectangle of copper formed for example from a printed circuit board in which case the antenna will be non-directional. For example, the rectangle may be a 1 to 2 inches square in which case the system would have a range of up to ten feet. If desired, a ground plane may be provided behind the active portion of the antenna which ground plane would then be connected to the other input terminal of the operational amplifier 21. Such an antenna with a ground plane may, for example, be formed from a printed circuit board which is clad on the both opposed surfaces thereof. It should further be noted, that the present system has the advantage that a plurality of antenna may be connected to the same operational amplifier 21 and that the active portions of the antenna, for example, the rectangular plates, may be displaced from the input of the amplifier by interconnecting same by means of a shielded cable. All of the types of antenna mentioned above, are for detection within a specified area within the range of the antenna.

It has further been found, however, that perimeter protection of a large area may be provided with the system according to the present invention by utilizing a length of unterminated coaxial cable as the antenna and by placing same around the perimeter of an area to be protected. As a result of the sensitivity of the system according to the invention, it has been found that the system will respond to persons stepping over such a length of coaxial cable, i.e. with no direct contact with or pressure on the coaxial cable, even when the coaxial cable was placed beneath a rug.

It should be noted that although the invention has been described for use as an intrusion detection apparatus, it is capable of being used for other purposes. For example, the basic circuit of the invention may be used to detect the presence of inanimate objects, for example a truck or a car, which produce a changing electric field.

It will be understood that the above description of the present invention is susceptible to various modifications, changes and adaptations, and the same are intended to be comprehended within the meaning and range of equivalents of the appended claims.

We claim:

1. A detection apparatus for sensing the change in electrostatic charge caused by the disturbance of the electric field within the range of said apparatus comprising in combination:

a high impedance antenna for sensing the electric field;

a charge detection circuit including an input terminal, an amplifying circuit having an input stage with a high input impedance and a low leakage current and at least one amplifying stage with a large voltage gain, means for connecting the signal input of said input stage to said input terminal, a first high ohmic input resistance connected between said signal input of said input stage and ground, and filter means connected to said signal inut for filtering out signals above approximately 20Hz;

said amplifying circuit including an operational amplifier having inverting and non-inverting inputs with said non-inverting input constituting said signal input of said input stage, a second resistance connected between the output of said operational amplifier and said inverting input to provide a feedback path for said amplifier, and a third resistance connecting said inverting input to ground;

means for shielding said charge detection circuit from stray signals;

shielded means connecting the output of said antenna to said input terminal; and means responsive to the output signal from said amplifier for producing an output signal whenever the amplitude of the output signal from said amplifier exceeds a predetermined value.

2. The apparatus defined in claim 1 wherein said filter means is a low pass filter having a cut off frequency of approximately 2Hz.

3. The apparatus as defined in claim 2 wherein said filter means connected to said signal input comprises a capacitor connected in parallel with said first high ohmic resistance to form a low pass filter.

4. The apparatus defined in claim 1 wherein said input stage includes respective field effect transistors each of whose gate electrode constitutes a respective one of said inputs of said operational amplifier.

5. The apparatus defined in claim 4 further comprising a further filter means having its input connected to the output of said amplifier and its output connected to the input of said means for producing an output signal, for filtering out power line frequency signals in the output signal from said amplifier.

6. The apparatus defined in claim 5 wherein said further filter means is a power line frequency notch filter.

7. The apparatus defined in claim 1 wherein each of said field effect transistors is an insulated gate field effect transistor.

8. The apparatus as defined in claim 4 further including means connected in the feedback path of said operational amplifier for shaping the gain of said operational amplifier so that it has very low gain for D.C. signals and has a substantially reduced gain for signals above approximately 1Hz.

9. The apparatus defined in claim 8 wherein said means for shaping the gain of said operational amplifier includes a filter formed by said second resistance and a capacitor connected in parallel with said second resistance.

10. The apparatus as defined in claim 9 wherein said second resistance comprises a T-network including a pair of resistors connected in series between said inverting input and said output of said operational amplifier and a further resistor having one end connected to the common junction of said pair of resistors and its other end coupled to ground via a further capacitor.

11. The apparatus defined in claim 10 wherein said filter means connected to said signal input comprises a capacitor connected in parallel with said first high ohmic resistance to form a low pass filter.

12. The apparatus defined in claim 11 wherein said filter means is a low pass filter having a cut off frequency of approximately 2Hz.

13. The apparatus defined in claim 12 wherein each of said field effect transistors is an insulated gate field effect transistor and further including a pair of oppositely poled diodes connected across said inputs of said operational amplifier, said diodes having a lower leakage characteristic than said input circuit.

14. The apparatus defined in claim 13 wherein the leakage current of the input of said operational amplifier is less than 5 picoamperes.

15. The apparatus defined in claim 1 wherein said means for producing an output signal includes means for producing an output signal of a predetermined constant frequency.

16. The apparatus defined in claim 15 wherein said means for producing an output signal further includes means for modulating said predetermined constant frequency with a subcarrier frequency.

17. The apparatus as defined in claim 16 wherein said coupling means is an A.C. power line and wherein said predetermined frequency is higher than the A.C. power frequency.

18. The apparatus defined in claim 15 further including a receiver responsive to said predetermined frequency; an indicator connected to the output of said receiver; and means coupling the input of said receiver to the output of said means for producing an output signal of a predetermined frequency.

19. The apparatus defined in claim 1 wherein said amplifying circuit means has a gain of at least 2000.

20. The apparatus defined in claim 1 wherein said antenna is a piece of wire.

21. The apparatus defined in claim 1 wherein said antenna is a length of unterminated coaxial cable.

* * * * *